US005417098A

United States Patent [19]

Hild

[11] Patent Number: 5,417,098

[45] Date of Patent: May 23, 1995

[54] HYDRAULIC FEED DRIVE FOR FLYING UPSETTING PRESSES

[75] Inventor: Berthold Hild, Burbach, Germany

[73] Assignee: SMS Schloemann-Siemag Aktiengesellschaft, Düsseldorf, Germany

[21] Appl. No.: 151,701

[22] Filed: Nov. 12, 1993

[30] Foreign Application Priority Data

Nov. 12, 1992 [DE] Germany ..... 42 38 154.1

[51] Int. Cl.[6] ..... B21J 9/12; B21B 15/00

[52] U.S. Cl. ..... 72/407; 72/184; 72/206; 72/453.01

[58] Field of Search ..... 72/407, 406, 453.01, 72/184, 189, 206

[56] References Cited

U.S. PATENT DOCUMENTS

| | | | |
|---|---|---|---|
| 4,213,320 | 7/1980 | Vydrin | 72/406 |
| 5,195,351 | 3/1993 | Heitze | 72/184 |

FOREIGN PATENT DOCUMENTS

| | | | |
|---|---|---|---|
| 149036 | 6/1988 | Japan | 72/206 |
| 255203 | 10/1990 | Japan | 72/184 |
| 81006 | 4/1991 | Japan | 72/184 |

*Primary Examiner*—Daniel C. Crane
*Attorney, Agent, or Firm*—Anderson Kill Olick & Oshinsky

[57] ABSTRACT

Hydraulic feed drives for pressing tools of a flying upsetting press are integrated into closed hydraulic circuits and are driven by displacement pumps, with the hydraulic circuits being pressurized in order to improve the flow dynamics, and with internal regulation circuits and superimposed regulations circuits of the individual control components being provided for improving the regulation accuracy.

7 Claims, 2 Drawing Sheets

3
3'
3''
1
2
4
5
22
22'
23
23'
8
8'
8''
9
9'
9''
10
11
6
6'
6''
7
7'
7''
12
12'
13
14
15
16
17
17'
18
18'
18''
18'''
18''''
18'''''
19
20
20'
21
21'
21''
21'''
21''''
21'''''

HYDRAULIC FEED DRIVE FOR FLYING UPSETTING PRESSES

BACKGROUND OF THE INVENTION

The invention relates to a feed drive for use in a flying upsetting press for reducing the widths of rolled material for moving a pressing tool, driven by a reduction gear, in a feed direction of the rolled material.

Feed drives of this type consist of electromechanical components which have a relatively high weight because of the output of power they have to generate. This results in a high mass inertia which in turn yields a slow and imprecise operation.

It is also known to provide feed drives with piston cylinder units which are regulated by full flow throttle control in an open circuit valves, for instance, servo valves. A disadvantage of these otherwise rapidly and precisely operating full flow throttle controls are high power losses. They have therefore not been used in upsetting presses.

Hydraulic displacement controls have also been developed, which operate with very low power losses, but cannot be used, however, for feed drives in upsetting presses because their volume flow dynamic for feed drives is too slow for feed drives.

Accordingly, the object of the invention is positional regulation for feed drives of flying upsetting presses, which operate sufficiently rapidly with low power losses.

SUMMARY OF THE INVENTION

The object of the invention is achieved by using hydraulic feed drives integrated in a closed hydraulic circuit and including each a displacement pump operating as an actuation member in the feed drive position controlling circuit.

Arranging the feed drives in closed hydraulic circuits assures operation of the feed drives with small power losses. A large or several small displacement pumps take care for a sufficiently large volume flow, and its dynamics in a closed hydraulic circuit. The position control circuits,together with a synchronization regulator enables a precise, equal regulation of the position of the pressing tools of the flying upsetting press.

Use of a displacement pump with a zero point control provides for its reverse operation and permits to effect a forward and backward movement of the pressing tool as well as a stoppage of the feed drive, if the press is to operate in a stop-and-go cycle. Pressurization of the hydraulic circuit assures improved dynamics, while a supply unit assures that the displacement pumps cannot run dry.

As a rule the replacement of leakage losses by cleaned and cooled hydraulic medium through the supply unit is sufficient in order to cool the systems. A possibility however also exists to design the supply units as flushing-supply units, which draw hydraulic liquid from the closed circuits, in addition to the leakage losses, then purify and cool the liquid and return it again to these circuits.

BRIEF DESCRIPTION OF THE DRAWING

The features and objects of the present invention will become more apparent, and the invention itself will be best understood from the following detailed description of the preferred embodiment when read with reference to the appended drawings, wherein FIG. 1 a control diagram of the feed drives of an upsetting press according to the invention.

DETAILED DESCRIPTION OF THE PREFERRED EMBODIMENT

Figure 1:
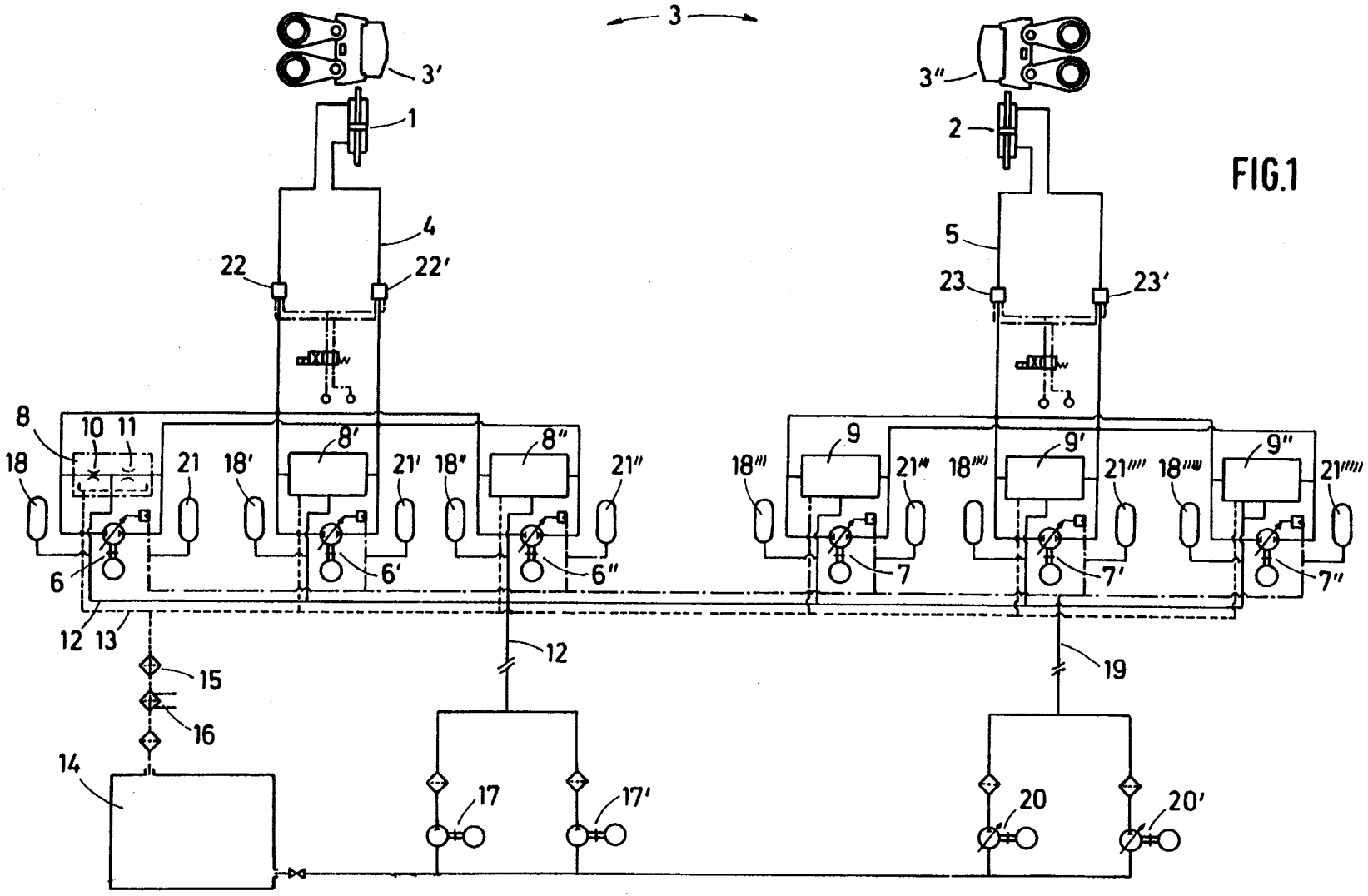

FIG. 1 shows feed drives 1, 2 for a press 3 which includes two pressing tools 3', 3'' operating opposite one another. The feed drives 1, 2 are respectively integrated into closed hydraulic circuits 4, 5, in which displacement pumps 6, 6', 6''; 7, 7', 7''; are disposed parallel to each other. The displacement pumps 6'' and 7'' are reserve units.

The respective high pressure side of the closed hydraulic circuits 4, 5 is connected to the corresponding low pressure side of the hydraulic circuits 4, 5 by preloaded throttling circuits 8, 8', 8'', 9, 9', 9''. The preloaded throttling circuits 8, 8', 8''; 9, 9', 9'' each, as shown in the example of the throttling circuit 8, consist of two throttles 10, 11 in series, between which a supply line 12 discharges.

The leakage losses of the entire closed hydraulic circuits and possibly of the hydraulic control circuits, for instance at the feed drives 1, 2, the displacement pumps 6, 7, the preload throttling circuits 8, 9 or at the corresponding junctions etc., are recovered and are fed by a return line 13 to a reservoir. Filters 15 and heat exchangers 16 are provided in the return line 13. The hydraulic liquid is supplied from the tank 14 by pumps 17, 17' to the supply line 12. Herein, the pump 17' may serve only as a reserve unit. The storage reservoirs 18 - 18'''' serve to equalize the system pressure.

Control circuits 19 for the displacement pumps 6, 7 are supplied by separate pumps 20, 20' from the tank 14, with pump 20' being a reserve unit. Here also the storage reservoirs 21 to 21'''' serve to equalize pressure fluctuations in the control system.

Check valves 22, 22'; 23, 23' can be actuated in such a way that the displacement pumps 6, 7 are blocked so that the feed drives 1, 2 are no longer supplied with hydraulic fluid by the displacement pumps 6, 7. In this case, the press can only operate in the stop and go type of operation.

Figure 2:
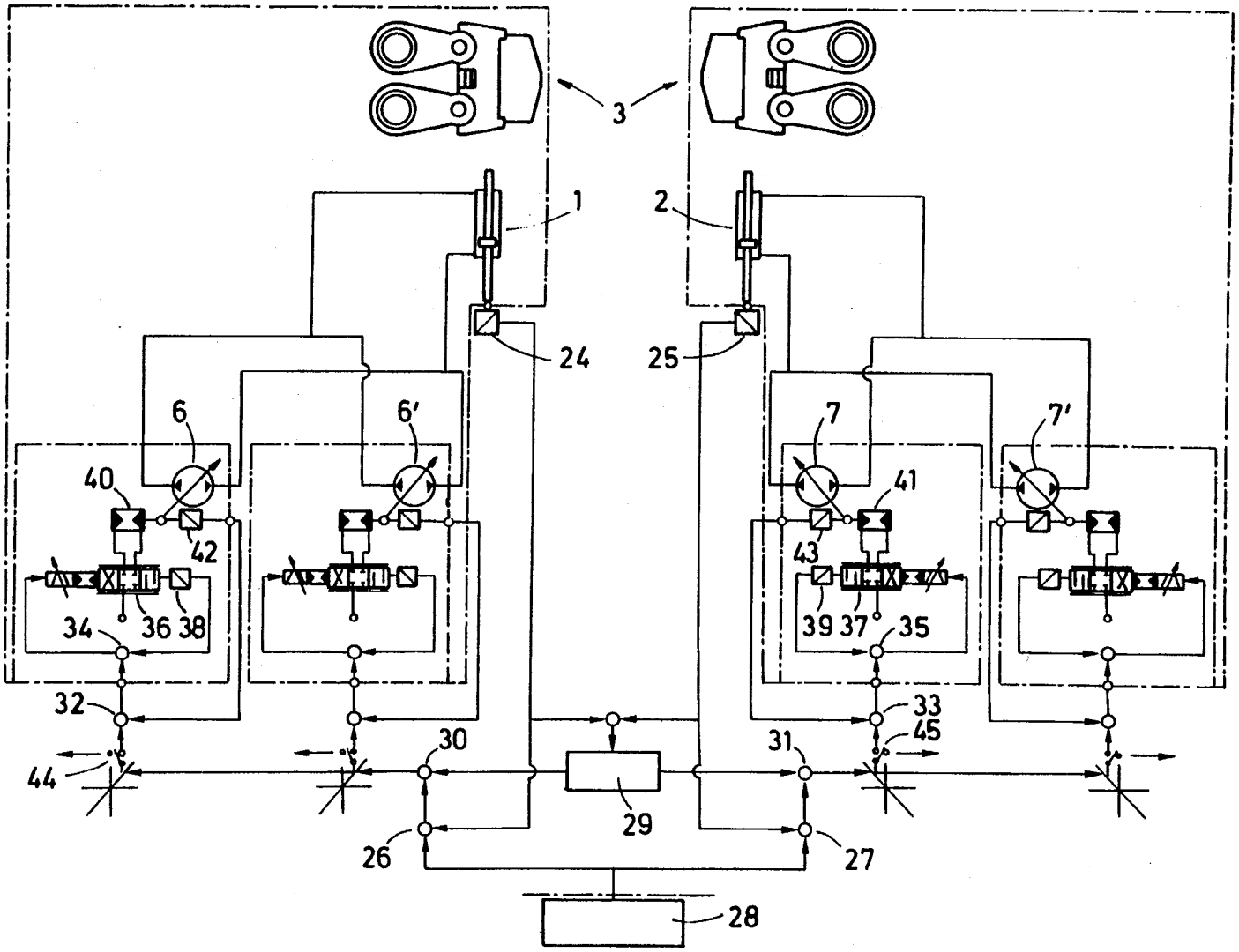
FIG. 2 a signal flow chart of the feed drives according to the invention.

FIG. 2 shows feed drives 1, 2 of the press 3, with position sensors 24, 25 being allocated to the feed drives 1 and 2. The position sensors 24, 25 are connected to summation units 26, 27 which are supplied with position nominal values from a processing computer 28. The output of the positional sensors 24, 25 are furthermore switched to a synchronization regulation unit 29, outputs of which are connected to the summation units 30, 31, which are supplied with the nominal actual value comparison from the summation units 26, 27. The outputs of the summation units 30, 31 are applied to four-way servo valves 36, 37 through additional summation units 32 to 35, which servo valves comprise displacement sensors 38, 39, which form an internal position control circuit with the summation units 34, 35.

Actuation members 40, 41 of the displacement pumps 6, 7 are fed through the four-way servo valves 36, 37 and are connected with angle sensors 42, 43 outputs of which are applied to the servo valves 36, 37 through the summation units 32, 33. The angle sensors 42, 43 form superpositioning angle regulation for the displacement angles of the displacement pumps 6, 7. The respective regulation circuits can be switched off, and the regulation circuit for the displacement pumps 6″, 7″ can be actuated by switches 44, 45. The reference numbers for the appropriate controls of the displacement pump 6′, 7′ have not been included in FIG. 2 for reasons of clarity.

What is claimed is:

1. A feed drive arrangement for moving pressing tools of a flying press for reducing a width of a rolled material, which are arranged opposite each other, in a feed direction of the rolled material, said feed drive arrangement comprising:

a feed drive for each of the pressing tool, said feed drive including a hydraulic feed drive, at least one displacement pump for supplying fluid pressure to said hydraulic feed drive, said hydraulic feed drive and said at least one displacement pump forming parts of a closed hydraulic circuit, and a position control circuit for controlling operation of said hydraulic feed drive, said at least one displacement pump functioning as a control element of said position control circuit; and a synchronization regulator connected with the position control circuits of the feed drives for assuring equal travel paths of the pressing tools.

2. A feed drive arrangement as set forth in claim 1, further comprising an actuator for the at least one displacement pump, and a servo valve for controlling medium flow to the actuator.

3. A feed drive arrangement for moving pressing tools of a flying press for reducing a width of a rolled material, which are arranged opposite each other, in a feed direction of the rolled material, said feed drive arrangement comprising:

a feed drive for each of the pressing tool, said feed drive including a hydraulic feed drive, at least one displacement pump for supplying fluid pressure to said hydraulic feed drive, said hydraulic feed drive and said at least one displacement pump forming parts of a closed hydraulic circuit, and a position control circuit for controlling operation of said hydraulic feed drive, said at least one displacement pump functioning as a control element of said position control circuit; and a synchronization regulator connected with the position control circuits of the feed drives for assuring equal travel paths of the pressing tools;

wherein said at least one displacement pump is a reversible pump with a zero point control, and wherein the closed hydraulic circuit is a pressurized system, said feed drive arrangement further comprising supply means for compensating losses resulting from leakage of pressure medium.

4. A feed drive arrangement as set forth in claim 3, further comprising at least two throttles arranged in series for connecting a high pressure side and a low pressure side of the closed hydraulic circuit for pressurizing the closed hydraulic circuit, said supply means comprising a conduit communicating with a conduit connecting the at least two throttles.

5. A feed drive arrangement as set forth in claim 4, wherein the supply means comprises means for returning leaked medium to a reservoir, said returning means including at least one of a heat exchanger and a filter.

6. A feed drive arrangement for moving pressing tools of a flying press for reducing a width of a roller material, which are arranged opposite each other, in a feed direction of the rolled material, said feed drive arrangement comprising:

a feed drive for each of the pressing tool, said feed drive including a hydraulic feed drive, at least one displacement pump for supplying fluid pressure to said hydraulic feed drive, said hydraulic feed drive and said at least one displacement pump forming parts of a closed hydraulic circuit, and a position control circuit for controlling operation of said hydraulic feed drive, said at least one displacement pump functioning as a control element of said position control circuit;

a synchronization regulator connected with the position control circuits of the feed drives for assuring equal travel paths of the pressing tools;

an actuator for the at least one displacement pump, and a servo valve for controlling medium flow to the actuator; and a displacement sensor having an output connected with a sliding spool of the servo valve for effecting internal position regulation.

7. A feed drive arrangement for moving pressing tools of a flying press for reducing a width of a rolled material, which are arranged opposite each other, in a feed direction of the rolled material, said feed drive arrangement comprising:

a feed drive for each of the pressing tool, said feed driving including a hydraulic feed drive, at least one displacement pump for supplying fluid pressure to said hydraulic feed drive, said hydraulic feed drive and said at least one displacement pump forming parts of a closed hydraulic circuit, and a position control circuit for controlling operation of said hydraulic feed drive, said at least one displacement pump functioning as a control element of said position control circuit;

a synchronization regulator connected with the position control circuits of the feed drives for assuring equal travel paths of the pressing tools;

an actuator for the at least one displacement pump, and a servo valve for controlling medium flow to the actuator; and an angle sensor associated with the at least one displacement pump, and a control circuit associated with the servo valve, an output signal of the angle sensor providing an actual value signal for the control circuit associated with the servo valve.

* * * * *